US008077121B2

(12) United States Patent
Ichikawa et al.

(10) Patent No.: US 8,077,121 B2
(45) Date of Patent: Dec. 13, 2011

(54) PLASMA DISPLAY PANEL DISPLAY DEVICE

(75) Inventors: Kei Ichikawa, Osaka (JP); Hirotsugu Fusayasu, Kyoto (JP); Hiroshi Kunimoto, Osaka (JP); Seiji Hamada, Osaka (JP); Ryo Matsubara, Osaka (JP)

(73) Assignee: Panasonic Corporation, Osaka (JP)

( * ) Notice: Subject to any disclaimer, the term of this patent is extended or adjusted under 35 U.S.C. 154(b) by 585 days.

(21) Appl. No.: 12/327,160

(22) Filed: Dec. 3, 2008

(65) Prior Publication Data

US 2009/0140953 A1 Jun. 4, 2009

(30) Foreign Application Priority Data

Dec. 4, 2007 (JP) ..... 2007-313341

(51) Int. Cl.
*G09G 3/34* (2006.01)

(52) U.S. Cl. ..... 345/60; 345/62; 345/66; 345/67

(58) Field of Classification Search ..... None
See application file for complete search history.

(56) References Cited

U.S. PATENT DOCUMENTS 6,342,873 B1 * 1/2002 Ueoka et al. ..... 345/60
7,199,773 B2 * 4/2007 Seo ..... 345/86

FOREIGN PATENT DOCUMENTS

JP 2005-221797 A 8/2005

* cited by examiner

*Primary Examiner* — Van Chow
(74) *Attorney, Agent, or Firm* — Hamre, Schumann, Mueller & Larson, P.C.

(57) ABSTRACT

The present invention sufficiently reduces unwanted radiation in a plasma display panel (PDP) display device. The display device includes a PDP having a pair of electrodes, a first, a second, and a third conductive member, and a pair of driving circuits used to apply a voltage to their respective electrodes. Each conductive member has substantially the same width and height as the PDP, and the first, second, third conductive members are disposed on the rear surface of the PDP, in this order on the rear side of the PDP. The PDP and the conductive members are connected electrically to one another in the end portions of these elements, either directly or via the driving circuits, so that the direction of the current flowing in the PDP during driving and discharge coincides with the direction of the current flowing in the third conductive member, and is opposite from the direction of the current flowing in the first conductive member and the second conductive member.

5 Claims, 8 Drawing Sheets

PLASMA DISPLAY PANEL DISPLAY DEVICE

BACKGROUND OF THE INVENTION

1. Field of the Invention

The present invention relates to plasma display panel display devices, and particularly a plasma display panel display device capable of reducing unwanted radiations that occur during the driving and discharge of a plasma display panel.

2. Description of Related Art

Because of advantages including a large screen size and a thin screen, plasma display panel display devices have been well-spread in recent years.

With reference to FIG. 4, conventional plasma display panel display devices are described below in regard to structure and image display operation. FIG. 4 is a lateral cross sectional view showing a schematic illustration of a structure of a conventional plasma display panel display device 100. As shown in FIG. 4, the display device 100 includes a plasma display panel (front panel) 1 that forms an image.

The plasma display panel 1 includes sustain discharge electrodes (hereinafter "X electrodes") and sustain-scan discharge electrodes (hereinafter "Y electrodes"), extending in the width direction of the plasma display panel, and disposed along the height direction of the plasma display panel in numbers corresponding to the number of display lines. The plasma display panel 1 also includes address electrodes that perform scan and discharge with the Y electrodes. The address electrodes are provided to cross the Y electrodes orthogonally, in numbers corresponding to the number of display dots. A discharge cell is formed at each intersection where the X electrodes and the Y electrodes cross the address electrodes.

As shown in FIG. 4, the display device 100 also includes: an aluminum chassis 2 disposed on the rear side (lower side in FIG. 4) of the plasma display panel 1; a substrate 3 provided with an X electrode driving circuit used to apply a driving pulse waveform to the X electrodes; a substrate 4 provided with a Y electrode driving circuit used to apply a driving pulse waveform to the Y electrodes; a flexible wiring substrate 5 connecting the X electrode driving circuit to the X electrodes; and a flexible wiring substrate 6 connecting the Y electrode driving circuit to the Y electrodes.

In the display device 100, an electrical interconnection is made between the ground of the X electrode driving circuit and one end of the aluminum chassis 2 (left end in FIG. 4), and between the ground of the Y electrode driving circuit and the other end of the aluminum chassis 2 (right end in FIG. 4).

For the driving of the display device 100, a sub-field driving method is used commonly, which controls display gradations by the number of discharges. Each sub-field includes a reset period, an address period, and a sustain discharge period.

The following describes an operation of the display device in each period. In the reset period, a reset pulse voltage is applied between the X electrodes and the Y electrodes to cause discharge in all pixels and erase the remaining wall charge of the previous sub-field. In the address period, a scan pulse is applied successively to the Y electrodes, and at the same time, an address pulse voltage is applied to the address electrodes of the pixels corresponding to the video display content, thereby causing address-discharge between the Y electrodes and the address electrodes to accumulate wall charges. In the sustain discharge period, a sustain-discharge pulse voltage is applied between the X electrodes and the Y electrodes to cause sustain-discharge in the pixels that accumulated the wall charges during the address period.

Due to the sustain discharge, vacuum ultraviolet rays are generated in the pixels. The vacuum ultraviolet rays irradiate the phosphors provided in the pixels, causing the phosphors to give off visible light and lighting the pixels. In the sustain discharge period, a driving voltage of several hundred volts and several hundred kHz is applied alternately to the X electrodes and the Y electrodes to cause discharge in the pixels between the electrodes. As a result, a large impulse current flows in the front panel during the sustain discharge period.

For example, applying a driving voltage to the X electrodes creates a large current flow in a loop path formed by the driver of the X electrode driving circuit, the X electrodes, the atmosphere in the pixels, the Y electrodes, the ground of the Y electrode driving circuit, the aluminum chassis 2, and the ground of the X electrode driving circuit. The large current in the loop generates a strong magnetic field, which is the primary cause of unwanted radiation in the display device.

JP2005-221797A discloses a plasma display device intended to reduce such unwanted radiation. In one aspect, JP2005-221797A discloses a device (first device) including: a plasma display panel having electrodes for causing discharge; a plurality of driving circuits for applying a voltage to the plasma display panel; a first wiring that interconnects the plasma display panel and the driving circuits; and a second wiring that interconnects the driving circuits by forming a first loop behind the driving circuits on the rear side of the plasma display panel, the magnetic field generated by a current flowing in the first loop being directed in the opposite direction from the magnetic field generated from a second loop formed by the driving circuits and the plasma display panel (claim 1). As shown in FIG. 6, in a device 400 of this publication, driving circuits 402 and 403 are connected to each other with a connector cable 404 of a size suited to connect these driving circuits. As shown in FIG. 6, the width of the connector cable 404 is considerably narrower than the height of a plasma display panel 401 (length along the vertical direction in FIG. 6).

In another aspect, JP2005-221797A discloses a device (second device) including: a plasma display panel having electrodes for causing discharge; a chassis disposed behind the plasma display panel; a conductive member disposed in front of the plasma display panel; and a plurality of driving circuits for applying a voltage to the plasma display panel, the magnetic field generated by a current flowing in the plasma display panel and the conductive member in response to the applied voltage from the driving circuits being directed in the opposite direction from the magnetic field generated by a current flowing in the plasma display panel and the chassis in response to the applied voltage from the driving circuits (claim 4). In a device 500 of this structure, when a plasma display panel 501 is driven by applying a voltage from driving circuits 502 and 503, a current that flows in the panel 501 branches into a conductive member 504, disposed in front of the panel 501, and a chassis 505, disposed behind the panel 501, as shown in FIG. 7.

In yet another aspect, JP2005-221797A discloses a device (third device) including: a plasma display panel having electrodes for causing discharge; a plurality of driving circuits for applying a voltage to the electrodes of the plasma display panel; a chassis interposed between the plasma display panel and the driving circuits; and metal boards paired with the driving circuits, the magnetic field generated by a current flowing in the plasma display panel and the chassis being directed in the opposite direction from the magnetic field generated by a current flowing in the driving circuits and the metal boards (claim 6). In a device 600 of this structure, as shown in FIG. 8, a driving circuit 602 and a metal board 604 are disposed at one end (left end portion in FIG. 8) on the rear surface of a plasma display panel 601, and a driving circuit 603 and a metal board 605 are disposed at the other end (right end portion in FIG. 8) on the rear surface of the panel 601. In this device, the magnetic field that cancels the magnetic field generated between the panel 601 and the chassis 606 is generated only in the vicinity of the ends of the panel 601.

The devices disclosed in JP2005-221797A are intended to reduce unwanted radiation by canceling the magnetic field components. However, it is difficult to reduce unwanted radiation sufficiently with these devices.

Regarding the first device, as shown in FIG. 6, since the connector cable is considerably narrower in height than the plasma display panel, the magnetic flux generated from the first loop and the magnetic flux generated from the second loop originate and terminate at different heights (vertical positions in FIG. 6), making it difficult to cancel out the magnetic field components generated in the device sufficiently.

In the second device, because the first and second current loops are formed by dividing the current from the plasma display panel, it is difficult to create the same current intensity in these current loops. Accordingly, it is difficult to cancel out the magnetic field components generated in the device sufficiently.

In the third device, as shown in FIG. 8, since the driving circuits 602 and 603 and their respective metal boards 604 and 605 are disposed only at the left end portion and right end portion, respectively, of the panel 601, the magnetic field generated between the panel 601 and the chassis 606 will not be cancelled sufficiently at the lateral middle portion of the panel 601.

BRIEF SUMMARY OF THE INVENTION

The present invention provides a plasma display panel display device, including: a plasma display panel having a first electrode and a second electrode; a first driving circuit to apply a voltage to the first electrode; a second driving circuit to apply a voltage to the second electrode; a first conductive member; a second conductive member; and a third conductive member. The first conductive member, the second conductive member, and third conductive member are substantially equal in width and height to the plasma display panel, and are disposed on a rear surface of the plasma display panel, in this order on a rear side of the plasma display panel. The plasma display panel display device forms such electrical interconnections that, during driving and discharge of the plasma display panel, a direction of a current flowing in the plasma display panel coincides with a direction of a current flowing in the third conductive member, and is opposite from a direction of a current flowing in the first conductive member and the second conductive member. The electrical interconnections are made: between the plasma display panel and the second conductive member via the first driving circuit, in a first end portion of the plasma display panel and a first end portion of the second conductive member; between the first conductive member and the third conductive member, in a portion in a first end portion of the first conductive member and a first end portion of the third conductive member; between the plasma display panel and the first conductive member via the second driving circuit, in a second end portion of the plasma display panel and a second end portion of the first conductive member; and between the second conductive member and the third conductive member, in a second end portion of the second conductive member and a second end portion of the third conductive member.

In the present invention, the plasma display panel and the first through third conductive members have substantially the same width and height, and interconnections are made in the end portions of these elements, so as to cancel out the magnetic field components generated between the plasma display panel and the first conductive member, and between the second conductive member and the third conductive member. The present invention therefore sufficiently reduces unwanted radiation in the plasma display panel display device.

DETAILED DESCRIPTION OF THE INVENTION

Figure 1:
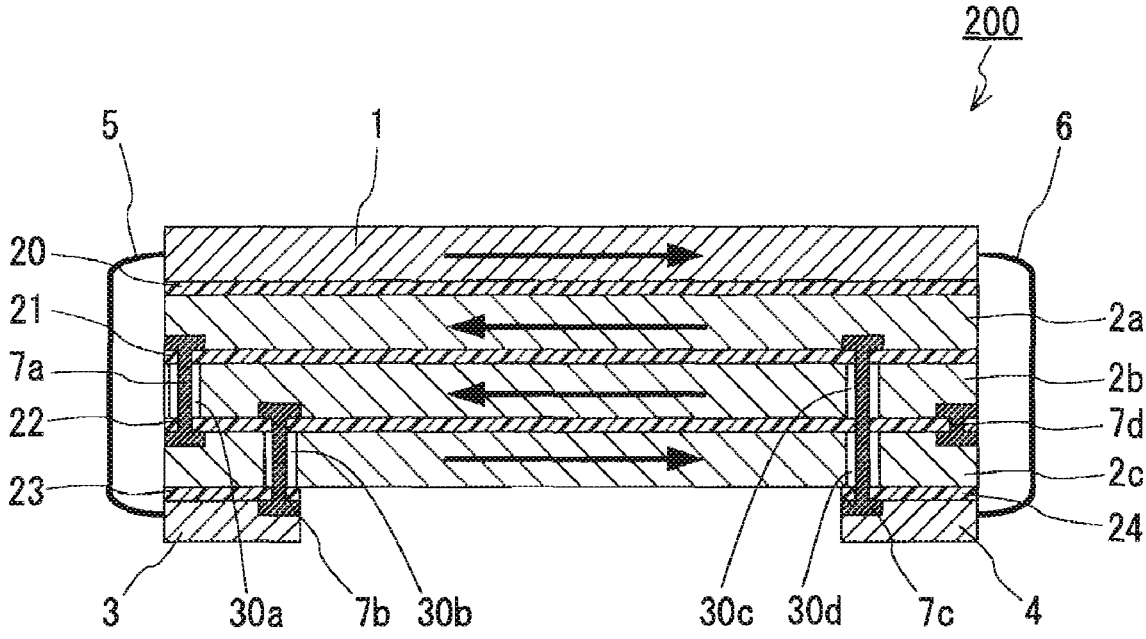
FIG. 1 is a lateral cross sectional view showing an example of a plasma display panel display device of the present invention.
Figure 5:
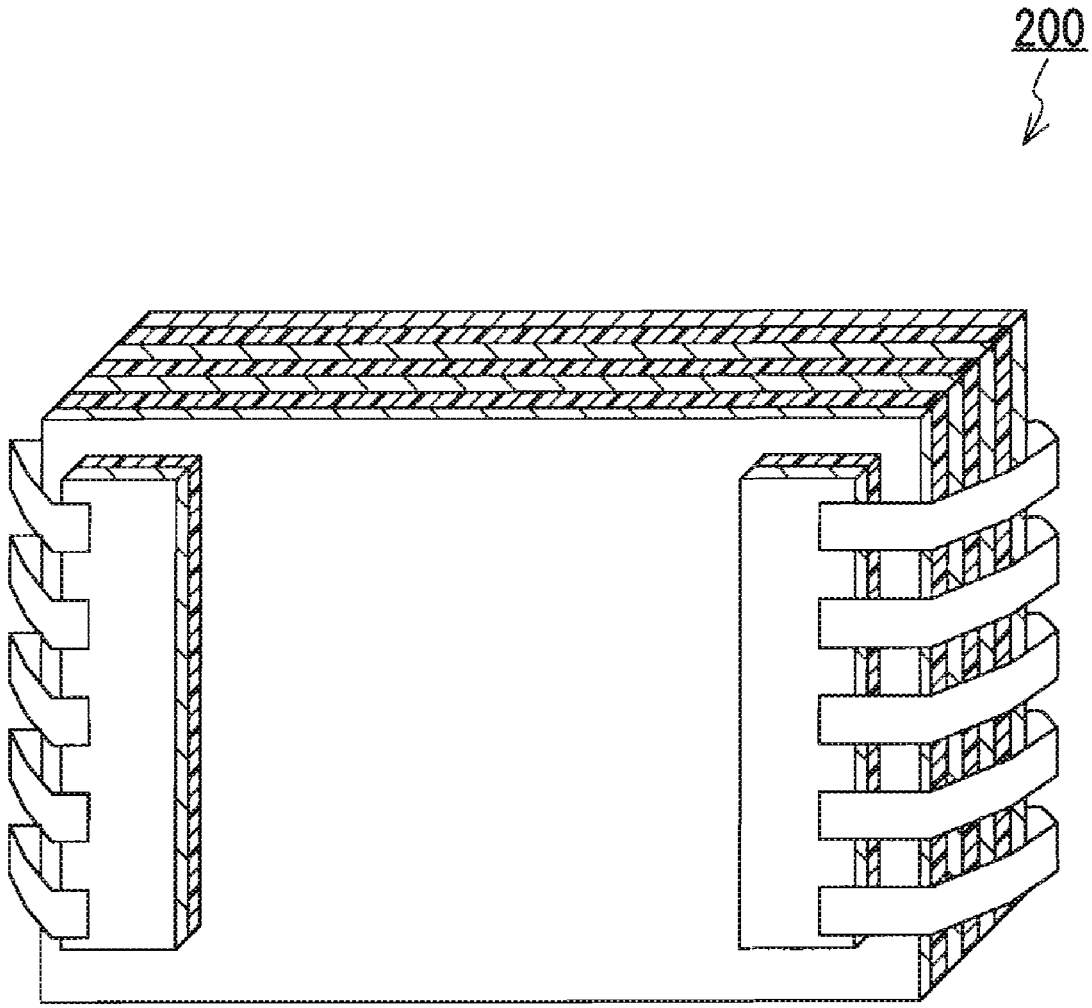
FIG. 5 is a perspective view of a plasma display panel display device of the present invention.
Figure 6:
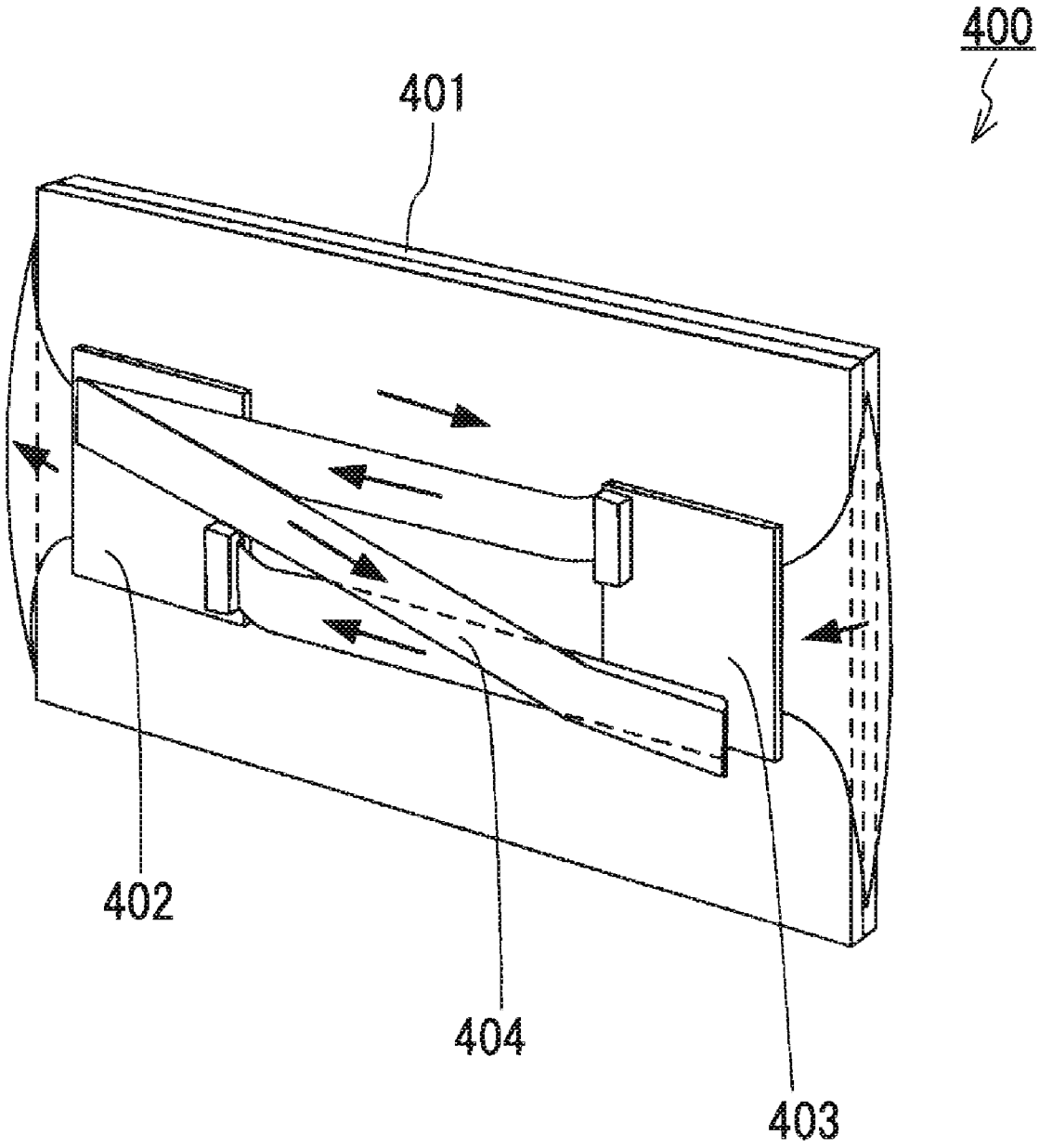
FIG.6 PRIOR ART
FIG. 6 is a perspective view showing another example of a conventional plasma display panel display device.
Figure 7:
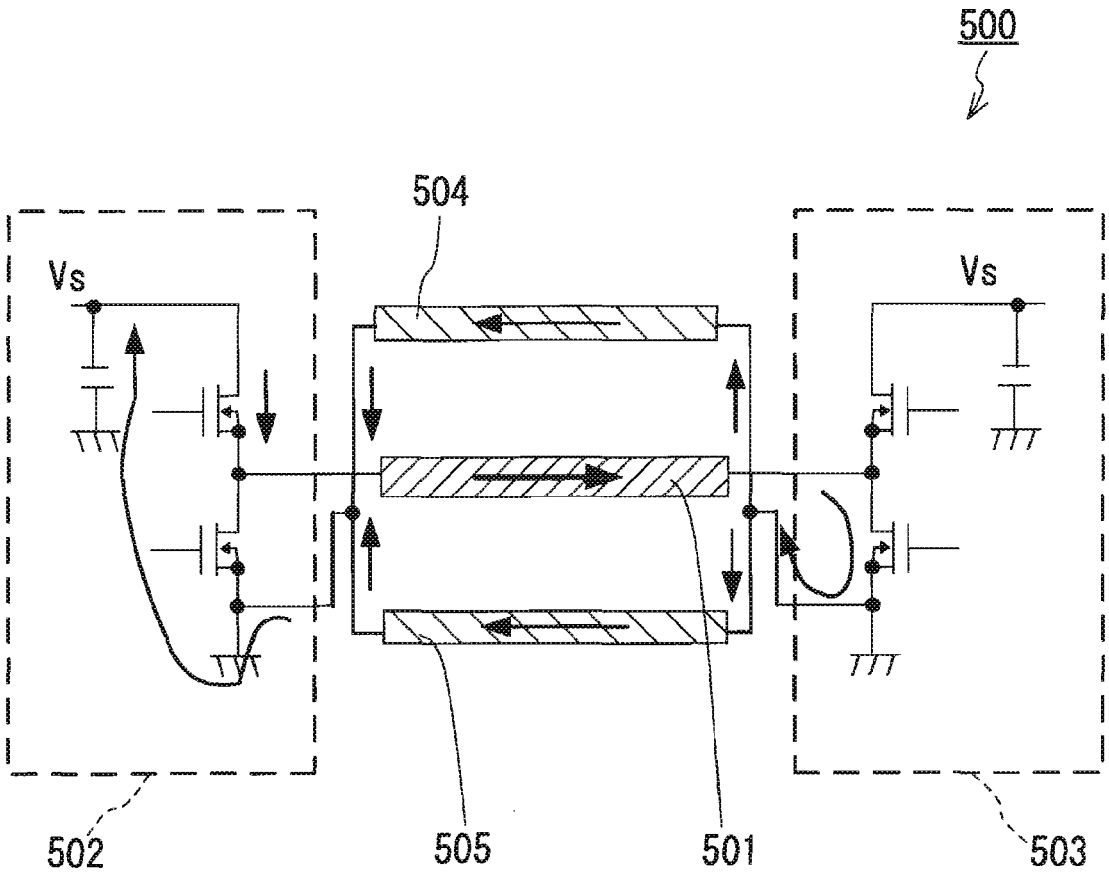
FIG.7 PRIOR ART
FIG. 7 is a circuit diagram of yet another example of a conventional plasma display panel display device.
Figure 8:
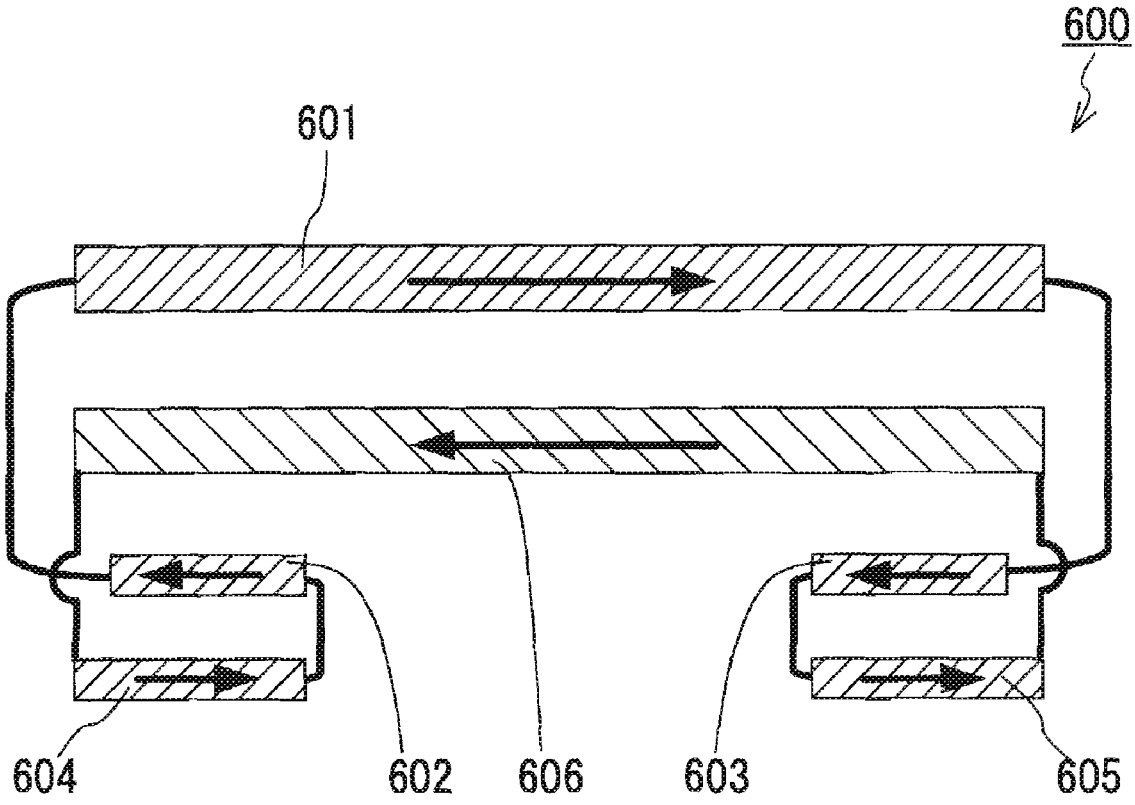
FIG.8 PRIOR ART
FIG. 8 is a lateral cross sectional view showing still another example of a conventional plasma display panel display device.

With reference to FIG. 1 and FIG. 5, the following will describe an embodiment (First Embodiment) of a plasma display panel display device of the present invention.

FIG. 5 is a perspective view of a plasma display panel display device of the present invention. FIG. 1 is a lateral cross sectional view of the display device shown in FIG. 5.

As shown in FIG. 1, a display device 200 includes: a plasma display panel (front panel) 1 to display an image; a first conductive member 2*a*; a second conductive member 2*b*; a third conductive member 2*c*; a substrate 3 provided with an X electrode driving circuit; a substrate 4 provided with a Y electrode driving circuit; flexible wiring substrates 5 and 6; conductors (joint members) 7*a*, 7*b*, 7*c*, and 7*d*; and insulating layers 20, 21, 22, 23, and 24. The first through third conductive members 2*a*, 2*b*, and 2*c* are provided as aluminum chassis.

Figure 2:
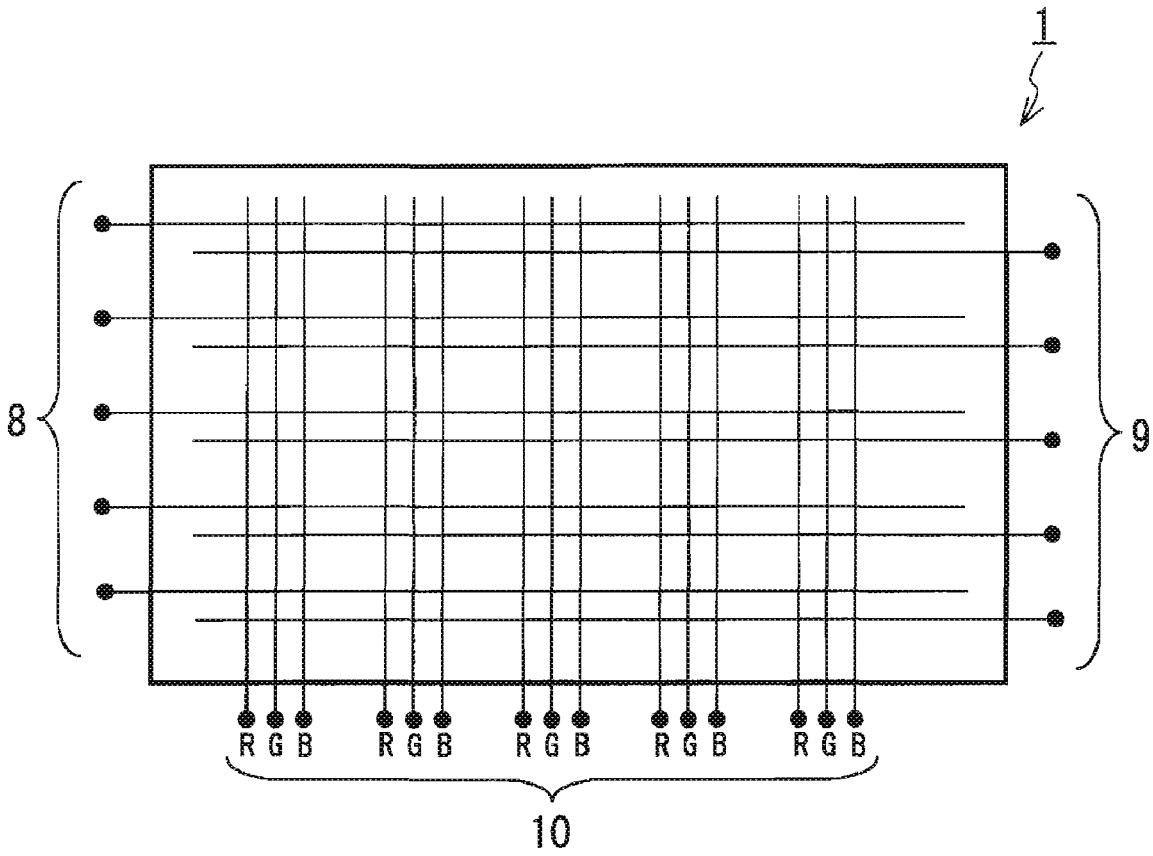
FIG. 2 is a conceptual diagram illustrating a layout of discharge electrodes on a front panel.

The front panel 1 can be realized by a known plasma display panel. FIG. 2 is a diagram explaining a layout of discharge electrodes provided for the front panel 1. For convenience of explanation, the figure shows only five display lines and five dots. As such, no further explanation is made as to the other structural members of the front panel 1. As shown in FIG. 2, the front panel 1 includes X electrodes 8 and Y electrodes 9, extending in the width direction (horizontal direction in FIG. 2) of the front panel, and disposed along the height direction (vertical direction in FIG. 2) of the front panel in numbers corresponding to the number of display lines. The front panel 1 also includes address electrodes 10 that perform scan and discharge with the Y electrodes 9. The address electrodes 10 are provided to cross the Y electrodes 9 orthogonally, in numbers corresponding to the number of display dots. A discharge cell is formed at each intersection where the X electrodes 8 and the Y electrodes 9 cross the address electrodes 10.

The first through third conductive members 2*a*, 2*b*, and 2*c* are disposed on the rear surface of the front panel 1, in this order on the rear side of the front panel 1. As used herein, the "rear surface" of the front panel 1 means the principal surface of the front panel 1 (lower principal surface in FIG. 1) on the opposite side of the principal surface forming an image, and the "rear side" of the front panel 1 means the side opposite to the image-forming principal surface.

The first through third conductive members 2*a*, 2*b*, and 2*c* have substantially the same width and height as the front panel 1. As used herein, the "width" of the front panel and the conductive members is used to define the length along the longer side of the front panel and the conductive members (horizontal direction in FIG. 5), and the "height" of the front panel and the conductive members means the length along the shorter side of the front panel and the conductive members (vertical direction in FIG. 5). Further, the conductive member "having substantially the same width" as the front panel means that the width of the conductive member is 90% to 110%, and preferably 95% to 105% of the width of the front panel. By "having substantially the same height," it means that the height of the conductive member is 90% to 110%, and preferably 95% to 105% of the height of the front panel.

The insulating layers 20, 21, and 22, realized by known insulators, are disposed between the front panel 1 and the conductive members 2*a*, 2*b*, and 2*c*. More specifically, the first insulating layer 20 is interposed between the plasma display panel 1 and the first conductive member 2*a*, the second insulating layer 21 between the first conductive member 2*a* and the second conductive member 2*b*, and the third insulating layer 22 between the second conductive member 2*b* and the third conductive member 2*c*. As shown in FIG. 1, the principal surfaces of the conductive members 2*a*, 2*b*, and 2*c* are face to face with each other via the insulating layers 21 and 22. The other principal surface of the first conductive member 2*a* faces the principal surface of the front panel 1 via the insulating layer 20.

From the standpoint of more reliably reducing unwanted radiation, it is preferable that substantially the same gap be created between the front panel 1 and the first conductive member 2*a*, and between the second conductive member 2*b* and the third conductive member 2*c*. This makes it easier to match the strength of the magnetic field created between the front panel 1 and the first conductive member 2*a*, and between the second conductive member 2*b* and the third conductive member 2*c*, during the driving and discharge of the front panel 1. As used herein, "substantially the same gap" means that the gap between the second conductive member and the third conductive member is 90% to 110%, and preferably 95% to 105% of the gap between the plasma display panel and the first conductive member. Such substantially the same gap can be created by forming the first insulating layer 20 and the third insulating layer 22 in substantially the same thickness. As used herein, "substantially the same thickness" means a thickness that falls within the foregoing ranges.

The substrate 3 is disposed on the rear surface of the third conductive member 2*c* via the insulating layer 23, in one end portion of the third conductive member 2*c* (left end portion in FIG. 1). The substrate 3 includes the X electrode driving circuit. The X electrode driving circuit applies a driving pulse waveform to the X electrodes of the front panel 1. The substrate 4 is disposed on the rear surface of the third conductive member 2*c* via the insulating layer 24, in the other end portion of the third conductive member 2*c* (right end portion in FIG. 1). The substrate 4 includes the Y electrode driving circuit. The Y electrode driving circuit applies a driving pulse waveform to the Y electrodes. The flexible wiring substrate 5 interconnects a driver of the X electrode driving circuit to the X electrodes. One end portion of the flexible wiring substrate 5 is connected to the X electrodes in the one end portion of the front panel 1 (left end portion in FIG. 1). The flexible wiring substrate 6 interconnects a driver of the Y electrode driving circuit substrate 4 to the Y electrodes. One end portion of the flexible wiring substrate 6 is connected to the Y electrodes in the other end portion of the front panel 1 (right end portion in FIG. 1). As used herein, "an end portion" of the plasma display panel means a region where the lateral distance from the end of the panel is 0% to 20%, preferably 0% to 10%, and particularly preferably 0% to 5% of the panel width.

The joint member can be realized by a conductive element, as represented by a screw. The joint member 7*a* electrically connects the first conductive member 2*a* and the third conductive member 2*c* in one end portion of these members (left end portion in FIG. 1). The joint member 7*a* makes no electrical contact with the second conductive member 2*b*. This can be realized, for example, by forming a through hole 30*a* in one end portion of the second conductive member 2*b*, and providing the joint member 7*a* in the through hole 30*a*, as shown in FIG. 1. An insulator may be provided between the wall surface of the through hole and the joint member. From the standpoint of creating a uniform current distribution in the conductive members, it is preferable to provide a plurality of similar, joint members 7*a*, equally spaced apart along the height direction of the display device (vertical direction in FIG. 5).

The joint member 7*b* connects the ground of the X electrode driving circuit to the second conductive member 2*b*, in one end portion of the second conductive member 2*b* (left end portion in FIG. 1). The joint member 7*c* connects the ground of the Y electrode driving circuit to the first conductive member 2*a*, in the other end portion of the first conductive member 2*a* (right end portion in FIG. 1). The joint member 7*d* is disposed on the rear surface of the second conductive member 2*b*, and connects the second conductive member 2*b* to the third conductive member 2*c* in the other end portion of these members (right end portion in FIG. 1). It also is preferable to provide a plurality of joint members 7*b*, 7*c*, and 7*d*, equally spaced apart along the height direction of the display device. As used herein, "an end portion" of the conductive member means a region where the lateral distance from the end of the conductive member is 0% to 20%, preferably 0% to 10%, and particularly preferably 0% to 5% of the width of the conductive member.

The joint member 7*b* makes no electrical contact with the third conductive member 2*c*. This can be realized, for example, by forming a through hole 30*b* in an end portion of the third conductive member 2*c*, and providing the joint member 7*b* in the through hole 30*b*, as shown in FIG. 1. The joint member 7*c* makes no electrical contact with the second and third conductive members 2*b* and 2*c*. This can be realized, for example, by forming a through hole 30*c* in the other end portion of the second conductive member 2*b*, and a through hole 30*d*, in communication with the through hole 30*c*, in the other end portion of the third conductive member 2*c*, and by providing the joint member 7*c* in the through holes 30*c* and 30*d*, as shown in FIG. 1. An insulator may be provided between the wall surface of the through hole and the joint member.

As described above, a plasma display panel display device of the present invention may be structured to include a conductor A, a conductor B, a conductor C, and a conductor D, wherein a first driving circuit is disposed on a rear surface of a third conductive member, in one end portion of the third conductive member, wherein a second driving circuit is disposed on the rear surface of the third conductive member, in the other end portion of the third conductive member, wherein a second conductive member includes a through hole A1 formed in one end portion of the second conductive member, and a through hole A2 formed in the other end portion of the second conductive member, wherein the third conductive member includes a through hole B1 formed in one end portion of the third conductive member, and a through hole B2, in communication with the through hole A2, formed in the other end portion of the third conductive member, wherein the conductor A is disposed in the through hole A1 to connect electrically the first conductive member and the third conductive member in one end portion of the first conductive member and one end portion of the third conductive member, wherein the conductor B is disposed in the through hole B1 to connect electrically the second conductive member to the first driving circuit in one end portion of the second conductive member, wherein the conductor C is disposed in the through holes A2 and B2 to connect electrically the first conductive member to the second driving circuit in the other end portion of the first conductive member, and wherein the conductor D is disposed on a rear surface of the second conductive member to electrically connect the second conductive member and the third conductive member in the other end portion of the second conductive member and the other end portion of the third conductive member. With these electrical interconnections made between the plasma display panel and the conductive members by the conductors disposed within the display device, no complex wirings will be required outside the display device.

The following describes the current path formed during the driving and discharge (sustain discharge period) of the front panel. The method of driving the front panel is essentially as in conventional examples, and as such, no explanation is made concerning the driving method.

Applying a higher voltage (driving voltage) to the X electrodes than to the Y electrodes causes a current to flow out of the power supply of the X driving circuit into the X electrodes, the atmosphere in the pixels, the Y electrodes, the ground of the Y electrode driving circuit, the first conductive member 2*a*, the third conductive member 2*c*, the second conductive member 2*b*, and the ground of the X electrode driving circuit, in this order. Here, as shown by arrows in FIG. 1, the direction of the current flow is as follows:

The front panel 1: from a first end portion to a second end portion (left to right in FIG. 1).

The first conductive member 2*a*: from a second end portion to a first end portion (right to left in FIG. 1).

The second conductive member 2*b*: from a second end portion to a first end portion (right to left in FIG. 1).

The third conductive member 2*c*: from a first end portion to a second end portion (left to right in FIG. 1).

The amount of current is the same in the conductive members and the front panel.

As described above, the front panel 1 and the first through third conductive members 2*a*, 2*b*, and 2*c* have substantially the same width and height, and accordingly the amount of current flowing in these members is the same during the driving and discharge of the front panel. This helps create a uniform current intensity and a uniform current distribution (width and height) in the front panel 1 and the first through third conductive members 2*a*, 2*b*, and 2*c* during the driving and discharge of the front panel. As a result, the first magnetic field component generated between the front panel 1 and the first conductive member 2*a*, and the second magnetic field component generated in the opposite direction between the second conductive member 2*b* and the third conductive member 2*c* can originate and terminate at the same height, and the magnetic fields can have substantially the same strength and width, making it possible to cancel out sufficiently the first magnetic field component and the second magnetic field component. This reduces the unwanted radiation in the display device. By creating substantially the same gap between the front panel 1 and the first conductive member 2*a*, and between the second conductive member 2*b* and the third conductive member 2*c*, it is possible to more reliably match the strength of the first magnetic field component and the strength of the second magnetic field component, enabling further reduction of the unwanted radiation in the display device.

Applying a higher voltage (driving voltage) to the Y electrodes than to the X electrodes causes a current to flow in the front panel 1 and the first through third conductive members 2*a*, 2*b*, and 2*c*, in the opposite direction from the current flown by the driving voltage applied to the X electrodes. For the same reasons, it also is possible in this case to reduce unwanted radiation, because the first magnetic field component and the second magnetic field component can originate and terminate at the same height, and the magnetic fields can have substantially the same strength and width.

The joint members may be realized by band conductors, instead of the screw conductors. The electrical interconnections made by the flexible wiring substrates and the joint members 7*a*, 7*b*, 7*c*, and 7*d* shown in FIG. 5 can be made by arranging a plurality of these elements along the height direction of the conductive members 2*a*, 2*b*, 2*c*, and 2*d*.

Figure 3:
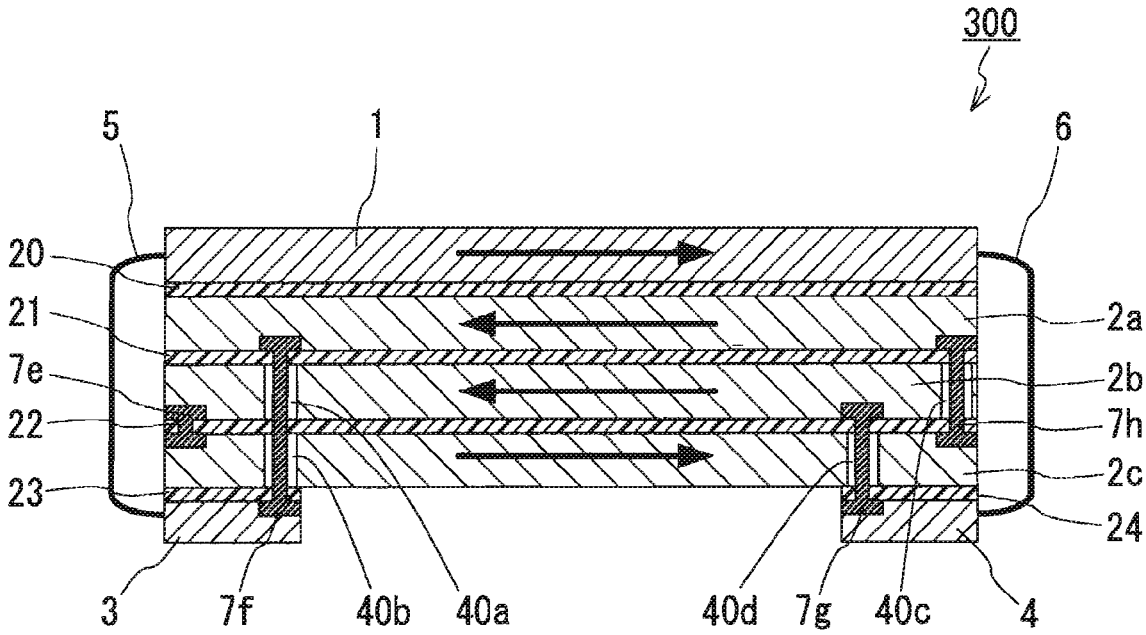
FIG. 3 is a lateral cross sectional view showing another example of a plasma display panel display device of the present invention.
Figure 4:
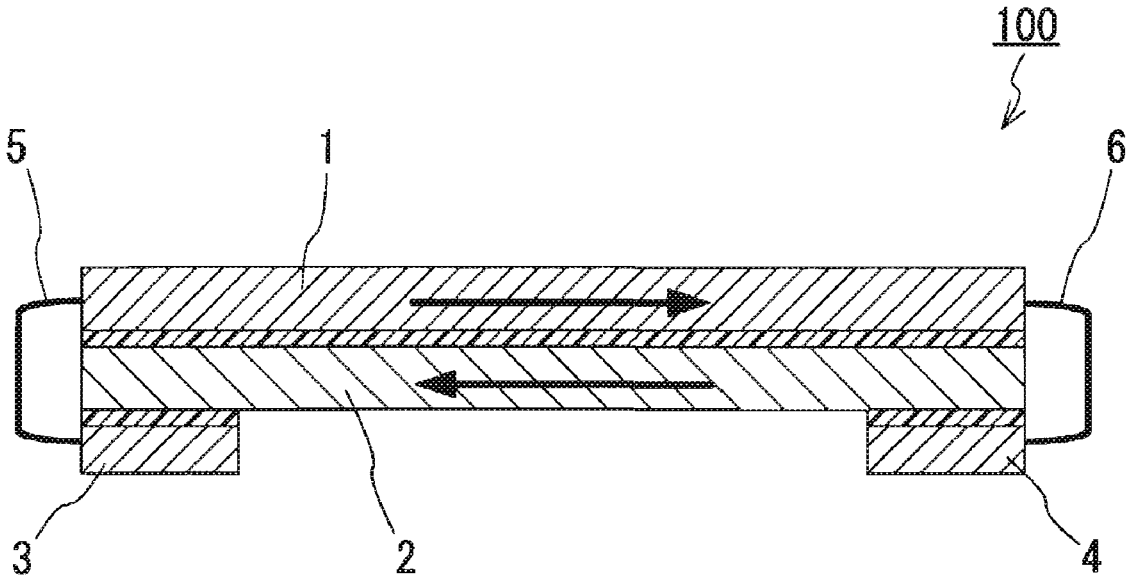
FIG.4 PRIOR ART
FIG. 4 is a lateral cross sectional view showing an example of a conventional plasma display panel display device.

The following will describe another embodiment (Second Embodiment) of a plasma display panel display device of the present invention, with reference to FIG. 3.

FIG. 3 is a lateral cross sectional view of another example of a plasma display panel display device of the present invention. A display device 300 according to the Second Embodiment of the present invention has the same structure as the display device 200 of the First Embodiment, except for the manner in which the interconnections are made by the joint members. As shown in FIG. 3, the display device 300 is structured to include: a joint member 7*e* electrically connecting the second conductive member 2*b* and the third conductive member 2*c* in the left end portion of these members; a joint member 7*f* electrically connecting the ground of the X electrode driving circuit to the first conductive member 2*a* in the left end portion of the first conductive member 2*a*; a joint member 7*g* electrically connecting the ground of the Y electrode driving circuit to the second conductive member 2*b* in the right end portion of the second conductive member 2*b*; and a joint member 7*h* electrically connecting the first conductive member 2*a* and the third conductive member 2*c* in the right end portion of these members.

The joint member 7*e* is disposed on the rear surface of the second conductive member 2*b*. The joint member 7*f* is disposed in a through hole 40*a*, formed in the left end portion of the second conductive member 2*b*, and a through hole 40*b*, formed in the left end portion of the third conductive member 2*c* and in communication with the through hole 40*a*. The joint member 7*g* is disposed in a through hole 40*d* formed in the right end portion of the third conductive member 2*c*. The joint member 7*h* is disposed in a through hole 40*c* formed in the right end portion of the second conductive member 2*b*.

As in the display device 200, applying a driving voltage to the X electrodes in the display device 300 causes a current to flow in the front panel 1 and the first through third conductive members 2*a*, 2*b*, and 2*c*, in substantially the same intensity and distribution in the directions of arrows shown in FIG. 3. Further, as in the display device 200, a current also flows in substantially the same intensity and distribution when a driving voltage is applied to the Y electrodes, but in the opposite direction from the current flowing due to the driving voltage applied to the X electrodes. This enables the display device 300 to cancel out sufficiently the first magnetic field component and the second magnetic field component during the driving and discharge of the front panel.

The present invention is therefore applicable to reduce the unwanted radiation in a plasma display panel display device.

The invention may be embodied in other forms without departing from the spirit or essential characteristics thereof. The embodiments disclosed in this specification are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A plasma display panel display device, comprising:

a plasma display panel having a first electrode and a second electrode;

a first driving circuit to apply a voltage to the first electrode;

a second driving circuit to apply a voltage to the second electrode;

a first conductive member;

a second conductive member; and a third conductive member, the first conductive member, the second conductive member, and third conductive member being substantially equal in width and height to the plasma display panel, and being disposed on a rear surface of the plasma display panel, in this order on a rear side of the plasma display panel, the plasma display panel display device forming electrical interconnections such that, during driving and discharge of the plasma display panel, a direction of a current flowing in the plasma display panel coincides with a direction of a current flowing in the third conductive member, and is opposite from a direction of a current flowing in the first conductive member and the second conductive member, the electrical interconnections being made:

between the plasma display panel and the second conductive member via the first driving circuit, in a first end portion of the plasma display panel and a first end portion of the second conductive member;

between the first conductive member and the third conductive member, in a first end portion of the first conductive member and a first end portion of the third conductive member;

between the plasma display panel and the first conductive member via the second driving circuit, in a second end portion of the plasma display panel and a second end portion of the first conductive member; and between the second conductive member and the third conductive member, in a second end portion of the second conductive member and a second end portion of the third conductive member.

2. The plasma display panel display device according to claim 1, wherein a gap between the plasma display panel and the first conductive member is substantially equal to a gap between the second conductive member and the third conductive member.

3. The plasma display panel display device according to claim 2, further comprising:

a first insulating layer interposed between the plasma display panel and the first conductive member;

a second insulating layer interposed between the first conductive member and the second conductive member; and a third insulating layer interposed between the second conductive member and the third conductive member, wherein the first insulating layer is substantially equal in thickness to the third insulating layer.

4. The plasma display panel display device according to claim 1, further comprising:

a first insulating layer interposed between the plasma display panel and the first conductive member;

a second insulating layer interposed between the first conductive member and the second conductive member; and a third insulating layer interposed between the second conductive member and the third conductive member.

5. The plasma display panel display device according to claim 1, wherein the first driving circuit is disposed on a rear surface of the third conductive member in the first end portion of the third conductive member, and the second driving circuit is disposed on the rear surface of the third conductive member in the second end portion of the third conductive member, and wherein the plasma display panel display device further comprises a conductor A, a conductor B, a conductor C, and a conductor D, the second conductive member having a through hole A1 formed in the first end portion of the second conductive member, and a through hole A2 formed in the second end portion of the second conductive member, the third conductive member having a through hole B1 formed in the first end portion of the third conductive member, and a through hole B2 formed in the second end portion of the third conductive member and in communication with the through hole A2, the conductor A being disposed in the through hole A1 to connect electrically the first conductive member and the third conductive member to each other in the first end portion of the first conductive member and the first end portion of the third conductive member, the conductor B being disposed in the through hole B1 to connect electrically the second conductive member and the first driving circuit to each other in the first end portion of the second conductive member, the conductor C being disposed in the through hole A2 and the through hole B2 to connect electrically the first conductive member and the second driving circuit to each other in the second end portion of the first conductive member, and the conductor D being disposed on a rear surface of the second conductive member to connect electrically the second conductive member and the third conductive member to each other in the second end portion of the second conductive member and the second end portion of the third conductive member.

* * * * *